US008534493B2

(12) United States Patent
Decker et al.

(10) Patent No.: US 8,534,493 B2
(45) Date of Patent: Sep. 17, 2013

(54) DISPENSER WITH SLOT APERTURE

(75) Inventors: Kip K. Decker, Neenah, WI (US); Micheal S. Lerch, Roswell, GA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 208 days.

(21) Appl. No.: 12/758,560

(22) Filed: Apr. 12, 2010

(65) Prior Publication Data

US 2010/0258580 A1 Oct. 14, 2010

Related U.S. Application Data

(63) Continuation-in-part of application No. 11/835,810, filed on Aug. 8, 2007, now abandoned.

(60) Provisional application No. 60/837,806, filed on Aug. 14, 2006.

(51) Int. Cl.
*B65H 1/00* (2006.01)

(52) U.S. Cl.
USPC ..... 221/63; 221/34; 221/35

(58) Field of Classification Search
USPC ..... 221/34, 35, 63, 61
See application file for complete search history.

(56) References Cited

U.S. PATENT DOCUMENTS

| | | | | |
|---|---|---|---|---|
| 2,118,380 | A | | 5/1938 | Gresenz |
| 2,323,395 | A | | 7/1943 | Harwood |
| 2,559,528 | A | | 7/1951 | Barrett |
| 3,012,692 | A | | 12/1961 | Petersen |
| 3,144,961 | A | * | 8/1964 | Phenner ..... 221/48 |
| 3,160,337 | A | | 12/1964 | Nelson |
| 3,161,336 | A | | 12/1964 | Loescher |
| 3,606,080 | A | | 9/1971 | Lynch et al. |
| 3,940,054 | A | | 2/1976 | Goebel et al. |
| 4,289,262 | A | | 9/1981 | Finkelstein |
| 4,462,507 | A | * | 7/1984 | Margulies ..... 221/63 |
| 4,583,642 | A | | 4/1986 | Blythe et al. |
| 4,623,074 | A | * | 11/1986 | Dearwester ..... 221/48 |
| 4,645,108 | A | | 2/1987 | Gavin et al. |
| 5,368,165 | A | * | 11/1994 | Ngyuen ..... 221/63 |
| 5,505,296 | A | | 4/1996 | Parker |

(Continued)

OTHER PUBLICATIONS

U.S. Office Action for U.S. Appl. No. 11/835,810 mailed Jun. 10, 2009.

(Continued)

*Primary Examiner* — Timothy Waggoner
(74) *Attorney, Agent, or Firm* — Michael V. Kruljac; Ram W. Sabnis

(57) ABSTRACT

A dispenser includes a housing having a dispensing wall, a bottom wall disposed opposite the dispensing wall, two side walls connecting the dispensing wall to the bottom wall, and two end walls connecting the dispensing wall, the bottom wall and the two side walls. A first slot aperture is disposed in the dispensing wall centered between the two end walls, the first slot aperture having a major axis oriented perpendicular to each of the two side walls. A second slot aperture is disposed in a first of the two side walls, the second slot aperture having a major axis oriented relative to the major axis of the first slot aperture such that the first slot aperture and the second slot aperture define a contiguous aperture between the dispensing wall and the first of the two side walls, the second slot aperture having a width less than a width of the first slot aperture.

10 Claims, 7 Drawing Sheets

(56) References Cited

U.S. PATENT DOCUMENTS

| | | | | |
|---|---|---|---|---|
| 5,516,001 | A * | 5/1996 | Muckenfuhs et al. | 221/63 |
| 5,520,308 | A | 5/1996 | Berg, Jr. et al. | |
| 5,613,608 | A | 3/1997 | Tronchetti et al. | |
| 5,897,023 | A | 4/1999 | Lee | |
| 6,299,017 | B1 | 10/2001 | Hill | |
| 6,349,849 | B1 | 2/2002 | Pehr | |
| 6,499,626 | B1 | 12/2002 | Julius | |
| 6,571,985 | B2 | 6/2003 | Wilkes et al. | |
| 6,588,130 | B1 * | 7/2003 | Yang | 40/410 |
| 6,877,634 | B2 | 4/2005 | Tramontina et al. | |
| 6,886,714 | B2 * | 5/2005 | Kruchoski et al. | 221/48 |
| 7,922,036 | B2 * | 4/2011 | Bendor et al. | 221/63 |
| 2006/0180596 | A1 * | 8/2006 | Young et al. | 221/63 |
| 2007/0170197 | A1 | 7/2007 | Decker et al. | |
| 2008/0035663 | A1 | 2/2008 | Byl et al. | |

OTHER PUBLICATIONS

U.S. Final Office Action for U.S. Appl. No. 11/835,810 mailed Dec. 14, 2009.

Mexican Office Action for U.S. Appl. No. MX/a/2007/009679 May 23, 2012.

* cited by examiner

DISPENSER WITH SLOT APERTURE

CROSS-REFERENCE TO RELATED APPLICATIONS

This application is a continuation-in-part of U.S. application Ser. No. 11/835,810, filed Aug. 8, 2007, pending, which claims the benefit of the filing date of U.S. Provisional Patent Application No. 60/837,806, filed Aug. 14, 2006, both of which are herein incorporated by reference in their entireties.

BACKGROUND

This disclosure relates to a dispenser for sheet products such as wipers, napkins, facial tissues, towels, and the like. More specifically, the disclosure relates to carton-type dispensers for sheet products.

Carton-type dispensers for sheet products such as wipers and tissues are well known in the art. Such sheet products may be supplied dry, with lotion, or moistened. The sheet products are generally rectangular in shape and are supplied as, for example, interleaved, discrete sheets or separably connected. Dispensers for such sheet products typically are in a carton form (e.g., a box form) and have an opening, typically at the top, through which individual articles or sheets are removed by the user. The desire for increased convenience led to sequential or "pop-up" dispensers. In a pop-up dispenser, a sheet product usually extends through an opening to an elevation above that of the dispenser. The user grasps the exposed portion of the sheet product, without the necessity of inserting fingers through the opening. In pop-up dispensing, each sheet product has a leading portion that is first to pass through the opening, and a trailing portion that later passes through the opening. In an interleaved arrangement, the trailing portion of a first sheet product to be dispensed overlaps the leading portion of the next sheet product to be dispensed. As the first sheet product is withdrawn by the user, the leading portion of the next sheet product is pulled through the opening for later dispensing. The sheet products are folded against one another in a variety of configurations so that the friction of the trailing portion of the withdrawn sheet against the succeeding sheet pulls the leading portion of the succeeding sheet through the opening.

One problem frequently encountered in pop-up dispensers is the transition from the reach-in dispensing mode in which the product is shipped to the pop-up dispensing mode preferred by the user, as well as recovery from the dispenser of sheet products that have fallen back in order to reinitiate the pop-up sequence. Typically, the opening through which the sheet product is dispensed is sized large enough to allow the user to reach his or her fingers therethrough to grasp the sheet product and begin the pop-up dispensing process. However, the opening is also typically sized to be small enough to constrict the sheet products dispensed therethrough, so that a sheet product may be separated from succeeding sheet products. Fallback is exacerbated with relatively tall dispensers that are often preferred by the user for economic reasons. The usable height of the dispenser is often limited to the length of the overlap of the interfolded sheet product. This limitation occurs due to the leading and trailing portions of adjacent sheet products unfolding inside a package taller than the overlap, resulting in the second sheet product falling back into the dispenser. Furthermore, fallback can occur as a consequence of the sheet product being impregnated with another substance, such as moisture, lotion, cleansing composition, and the like. When the sheet product is impregnated it is heavier and its surface friction may be reduced, therefore making it more susceptible to falling back.

A common problem among carton-type dispensers involves the issue of "double pull." This occurs when more than one sheet product comes out when the leading sheet product is withdrawn. Additionally, the problem of "streaming" can occur in carton-type dispensers. Streaming occurs when the user pulls the first sheet product out, and subsequent sheet products are also withdrawn, with separation of the following ones sometimes occurring.

All of these situations are defined as quality defects, and they are considered to be major inconveniences to the user. A continual need exists in the art for dispensers that eliminate these problems and improve the performance of dispensers, especially carton-type dispensers.

BRIEF SUMMARY

Disclosed herein are sheet product dispensers with a slot aperture.

In one embodiment, the dispenser comprises a housing including a dispensing wall, a bottom wall disposed opposite the dispensing wall, two side walls connecting the dispensing wall to the bottom wall, and two end walls connecting the dispensing wall, the bottom wall and the side walls; a slot aperture being disposed in the dispensing wall centered between the ends walls, while being disposed a distance away from one of the side walls, the slot aperture defining at least a sheet product retaining structure including a pair of adjacent side walls sufficiently close to one another to grasp and retain individual sheet products at least partially removed from the housing, the slot aperture having a length about 20% to about 50% of a width of individual sheet products; and a second aperture being disposed in one of the side walls, and being sufficiently large to permit the sheet products to be grasped by one or more fingers of a human hand from above the second aperture in order to pass individual sheet products at least partially through the slot aperture.

In one embodiment, a dispenser comprises a housing including a plurality of walls, wherein adjacent walls of the plurality of walls are perpendicular to form a box-like structure; a slot aperture being disposed in a first wall of the plurality of walls, the slot aperture defining at least a sheet product retaining structure including a pair of adjacent side walls sufficiently close to one another to grasp and retain individual sheet products at least partially removed from the housing; a second aperture being disposed in a second wall of the plurality of walls and being sufficiently large to permit the sheet products to be grasped by one or more fingers of a human hand from above the second aperture in order to pass individual sheet products at least partially through the slot aperture, wherein the second aperture is generally perpendicular to the slot aperture; and a channel being disposed in the first wall and connecting the slot aperture to the second aperture, the channel being defined by a pair of adjacent parallel side walls.

In one embodiment, a dispenser comprises a housing including a dispensing wall, a bottom wall disposed opposite the dispensing wall, two side walls connecting the dispensing wall to the bottom wall, and two end walls connecting the dispensing wall, the bottom wall and the side walls; a slot aperture being disposed in the dispensing wall off-centered between the end walls, while being disposed a distance away from one of the side walls, the slot aperture defining at least a sheet product retaining structure including a pair of adjacent side walls sufficiently close to one another to grasp and retain individual sheet products at least partially removed from the housing; and a second aperture being disposed in one of the side walls, and being sufficiently large to permit the sheet products to be grasped by one or more fingers of a human hand from above the second aperture in order to pass individual sheet products at least partially through the slot aperture.

In one embodiment, a dispenser includes a housing having a dispensing wall, a bottom wall disposed opposite the dispensing wall, two side walls connecting the dispensing wall to the bottom wall, and two end walls connecting the dispensing wall, the bottom wall and the two side walls. A first slot aperture is disposed in the dispensing wall centered between the two end walls, the first slot aperture having a major axis oriented perpendicular to each of the two side walls. A second slot aperture is disposed in a first of the two side walls, the second slot aperture having a major axis oriented relative to the major axis of the first slot aperture such that the first slot aperture and the second slot aperture define a contiguous aperture between the dispensing wall and the first of the two side walls, the second slot aperture having a width less than a width of the first slot aperture.

The above described and other features are exemplified by the following Figures and detailed description.

BRIEF DESCRIPTION OF THE DRAWINGS

Referring to the exemplary drawings wherein like elements are numbered alike in the several Figures.

DETAILED DESCRIPTION

Disclosed herein is a dispenser for, among other things, sheet products that comprises one or more slot apertures that are configured to minimize or eliminate the problems encountered in the prior art dispensers (e.g., "fallback", "double-pull", "streaming", and the like). A slot aperture provides an optimum level of resistance to a sheet product. The slot aperture may take on various sizes and angular orientations relative to the dispenser walls. While the dispenser is discussed hereinafter as being a disposable carton-type dispenser for convenience in discussion, it is to be understood that in various embodiments the dispenser may be refillable. In other words, the dispenser may be disposable or refillable. Further, in various embodiments, the dispenser may be used in dispensing dry sheet products, moisture-impregnated sheet products, paper products, Hydroentangled Fabric (HEF) wipes, Double ReCrepe (DRC) wipes, or airlaid fabric wipes.

As used herein, the term "disposable" dispenser refers to a dispenser intended to be discarded after the sheet products supplied therewith are depleted, that is, the dispenser is not intended to be restocked with such articles. In contrast, the term "refillable" refers to a dispenser that may be restocked with sheet products after the supply has been depleted.

The term "sheet products" is inclusive of natural and/or synthetic cloth or paper sheets. Further, sheet products can include both woven and non-woven articles. Examples of sheet products include, but are not limited to, wipers, napkins, tissues, and towels.

The term "moisture-impregnated sheet products" is defined to include articles impregnated with at least one substance. Suitable impregnating substances include, but are not limited to, water, a surface cleaner, a cleaning composition capable of attracting particulate matter, a medicament, skin cleanser, skin moisturizer, skin lotion and antiseptic.

Figure 3:
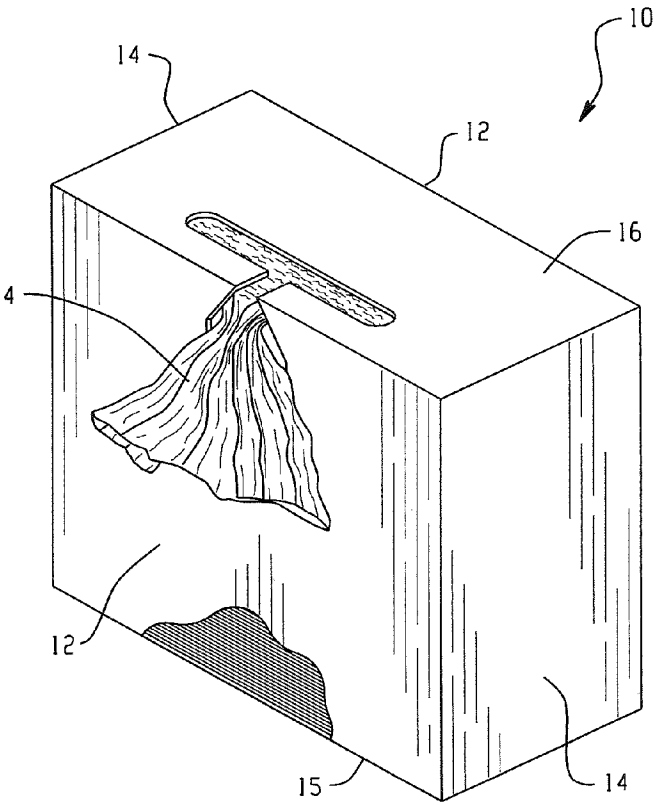
FIG. 3 is a perspective view of the embodiment of a dispenser of FIG. 1 that illustrates another mode of operation of the dispenser.
Figure 1:
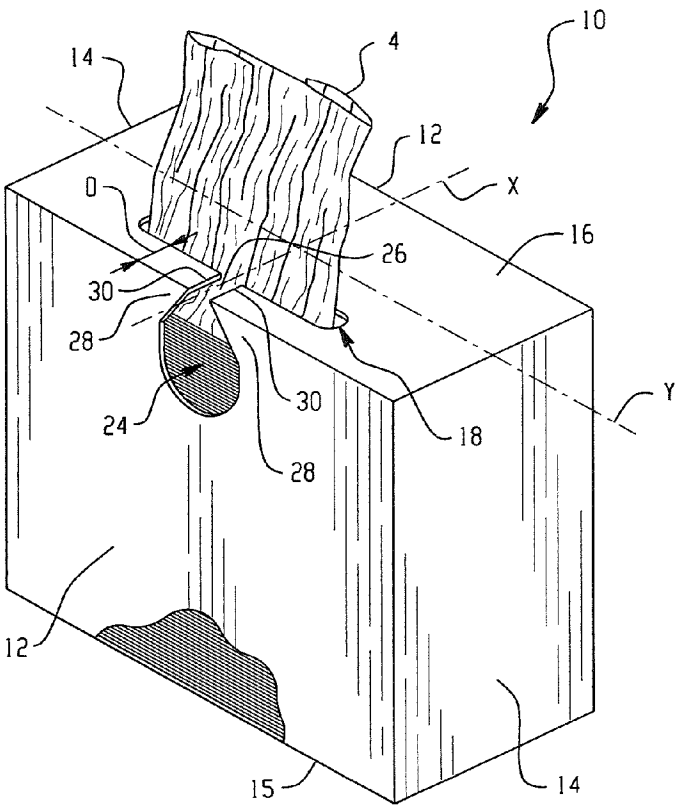
FIG. 1 is a perspective view of an embodiment of a dispenser for sheet products that illustrates one mode of operation of the dispenser.
Figure 2:
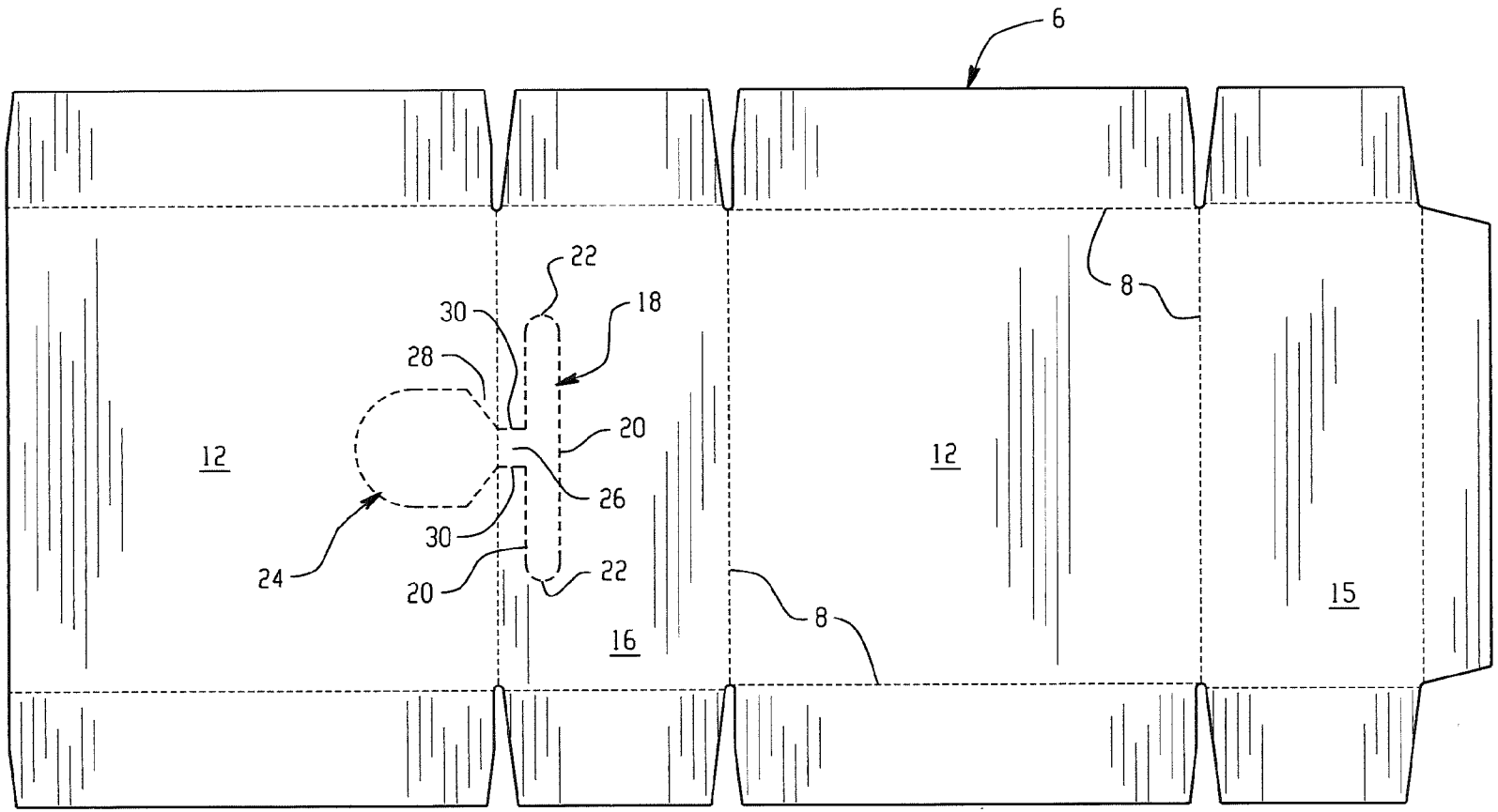
FIG. 2 representatively shows a top view of a blank form suitably used to define the dispenser of FIG. 1.

Referring now to FIGS. 1-3, an embodiment of a dispenser, generally designated 10, is illustrated. The dispenser 10 may be portable and lightweight, a rigid container, a semi-rigid container, a flexible container, or any combination of the foregoing, and the like. The materials for the dispenser can vary depending on the desired application, that is, whether the dispenser is intended to be disposable or refillable. Suitable materials for the dispenser include, but are not limited to, paperboard product and plastics (e.g., a polyolefin such as polypropylene).

Paperboard products may be particularly useful for making a low cost disposable container. Suitable paperboard products include, but are not limited to, cardboard, corrugated cardboard, fiberboard, and composite materials. In addition, the paperboard can be combined or treated with one or more additional materials in order to improve the strength, water resistance, colorfastness or other characteristics as desired. By way of example only, the paperboard can be coated or impregnated with one or more resins or polymeric materials such as waxes, polyolefins, polyvinylidine chlorides, polyvinyl chlorides, and the like. In addition, paperboard product can comprise, in whole or in part, laminate or multi-layer materials such as, for example, two or more layers of paperboard bonded together.

The dispenser 10 can comprise a size and shape corresponding to the desired shape of the sheet products and the desired volume of the sheet products. Suitable shapes for the dispenser include, but are not limited to, parallelepiped, cylindrical and polygonal. For example, the dispenser may be generally in the shape of an elongated box. In one embodiment, the dispenser 10 has an elongated box shape defined by six walls. More particularly, the dispenser comprises two side walls 12 disposed adjacent to two end walls 14, a bottom wall 15 located adjacent to all of the side walls 12 and end walls 14, and a dispensing wall 16 located on the opposite end from the bottom wall 15 and is adjacent to all of the end walls 14 and side walls 12 of the dispenser 10. The terms side walls, end walls, bottom wall and dispensing wall are used merely for convenience in discussion and do not necessarily represent spatial orientation relative to the user. For example, in some embodiments the dispensing wall 16 may be located at the "bottom" of the dispenser 10 relative to a user when the dispenser is mounted, for example, on a wall.

Disposed in dispensing wall 16 is a slot aperture 18, which is disposed in a central portion of the dispensing wall 16. For example, the slot aperture 18 may be disposed in the center of the dispensing wall 16 along the y-axis (shown as a dotted line). In the illustration, the y-axis is perpendicular to end walls 14. Additionally, the slot aperture 18 may be disposed in the center of the dispensing wall 16 along the x-axis (shown as a dotted line). In the illustration, the x-axis is perpendicular to the side walls 12. In the embodiment illustrated in FIGS. 1-3, the slot aperture is off-set from the center along the x-axis. More particularly, the slot aperture 18 is located proximate to one side wall 12, but is not in contact with the side wall 12. Rather, the slot aperture is disposed a distance "D" from the side wall and is parallel to the side walls 12.

The distance "D" can vary depending on the types of material used for the dispenser 10, as well as the type of sheet product 4 being dispensed. In one embodiment, the distance "D" is greater than or equal to the width of the slot aperture 18. The slot aperture 18 is defined by a pair of generally parallel sides 20 that are in physical communication with each other via rounded ends 22 (e.g., U-shaped ends). As such, the distance between parallel sides 20 corresponds to the "width" of the slot aperture 18. Rounded ends 22 advantageously help to prevent tearing of the sheet product as it is dispensed through the slot aperture 18. Sides 20 are sufficiently close to one another to frictionally engage and retain individual sheet products 4 (e.g. wipes) that are at least partially removed or dispensed from dispenser 10. For example, in one embodiment, the distance from one side 20 to the other side 20 is less than or equal to 0.5 inches, particularly less than or equal to 0.375 inches. In one embodiment, the distance is about 0.250 inches to about 0.5 inches. The slot length may be about 20% to about 50% of the overall width of the sheet product 4. For example, in one embodiment, the slot length is about 33% of the overall width of the sheet product 4.

In one embodiment, the slot aperture 18 is connected to an aperture 24, which is disposed in a side wall 12 via a channel 26. However, embodiments are envisioned where the aperture 24 is not connected to the slot aperture 18. The aperture 24 may be centered along the y-axis (shown as a dotted line). The aperture 24 has a size and shape that allows a user to reach into the dispenser 10 and grab a lead sheet product 4. The aperture 24 also has a transition portion defined by protrusions 28, which narrow the size of the aperture 24 in an area adjacent to the dispensing wall 16. In other words, the aperture 24 has a non-uniform geometry in the side wall 12. For example, as illustrated, the aperture 24 has a U-shaped end and a truncated V-shape end proximate to the channel 26. This reduction in size of the aperture 24 toward dispensing wall 16 provides a transition to the channel 26.

The aperture 24 extends along a side wall 12 in a direction away from the dispensing wall 16, that is, in a direction toward the bottom wall 15. The length that the aperture 24 extends along the side wall 12 is less than the entire height of the side wall 12, more specifically a distance less than or equal to half the height of the side wall 12, and even more specifically a distance less than or equal to a quarter of the height of the side wall 12. In one embodiment, the length that the aperture 24 extends along the side wall 12 is a distance less than or equal to an eighth of the height of the side wall 12. The height of the side wall 12 is defined as the distance between the dispensing wall 16 and the bottom wall 15.

The aperture 24 allows a user to retrieve sheet products 4 that may have fallen back into dispenser 10 and to return to the dispensing procedure. Sheet products may also be dispensed through the aperture 24. Side dispensing is advantageous for some applications, for example, where the dispenser 10 is disposed on a shelf such as those employed in grocery stores at the cash register.

The channel 26 provides a means for the user to easily fish the lead sheet product 4 to the slot aperture 18. The channel 26 is defined by generally parallel sides 30. As illustrated, the channel 26 is perpendicular to the slot aperture 18 forming a T-shaped aperture in the dispensing wall 16. The channel length along the x-axis corresponds to the distance "D" that the slot aperture 18 is away from the side wall 12.

In one embodiment, the dispenser 10 may be formed from a single sheet of paperboard blank stock 6, which is cut along its perimeter and pressed and/or scored along fold lines 8 and adapted to be folded into a one-piece rectangular container, generally shown in FIG. 1. Slot aperture 18, aperture 24, and channel 26 are formed by a material removal process. More particularly, slot aperture 18, aperture 24, and channel 26 are defined upon user removal of blank portions. Blank portion (shown in FIG. 2) may be formed during manufacturing via a die cut process or similar known paper board processing technologies. Prior to use, blank portion can be removed by a consumer to provide access to the sheet products 4.

The sheet products 4 are disposed within the dispenser 10 such that they are releasably attached to each previous and subsequent sheet product (except, respectively, for the first and last) by any releasable attachment means that allows easy separation to occur as the sheet product is being dispensed. Suitable releasable attachment means include, but are not limited to, friction, cohesion, or other forces that releasably attach adjacent articles. Perforations upon the articles may serve to provide releasable detachment between adjacent articles. In one embodiment, perforations may be defined by a series of 0.030 inch perforations. Where articles are interleaved, releasable attachment results from friction or cohesion between adjacent articles. One skilled in the art can readily determine the appropriate configuration without undue experimentation to assure separation of the articles without undue tearing as well as assuring that the article is dispensed through the dispenser aperture(s) to assure availability of the succeeding article in the pop-up mode.

In one method of use, the user may withdraw the sheet products 4 through a pulling motion directed upward and through the slot aperture 18 until the adjacent sheet products 4 are separated by tearing along a perforation. The subsequent sheet product 4 is retained within the slot aperture 18 and a portion of the sheet product 4 extends upwardly from aperture 18. As a result, fall back of sheet products 4 is minimized. In another method of use, the user may withdraw the sheet product 4 through aperture 24 as depicted in FIG. 3. It is envisioned that during the life of the product, individual sheet products 4 may be passed through the slot aperture 18 and/or the aperture 24.

Advantageously, the dispenser 10 reduces or eliminates the problems associated with previous disposable sheet product dispensers (e.g., carton-type dispensers). The problems of fall-back, double pull, multiple pulls, and streaming are either eliminated or reduced through use of at least the slotted aperture 18. Slot aperture 18 provides an optimal amount of resistance on the single sheet product 4 within the dispenser 10, to minimize fall backs, streaming and premature tearing of product perforations. This optimal amount of resistance created by slot aperture 18 creates an improved separation between the single sheet product 4 and, for example, the clip of interfolded sheet product 4. As a result, the aforementioned problems of fall-back, double pull, multiple pulls, and streaming are either reduced or eliminated.

Figure 5:
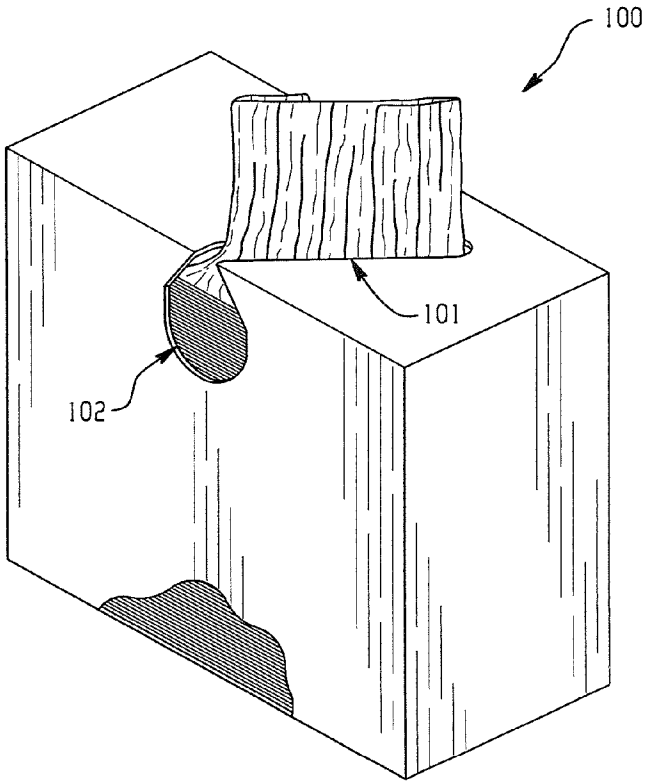
FIG. 5 is a perspective view of an embodiment of a dispenser for sheet products that illustrates one mode of operation of the dispenser.
Figure 4:
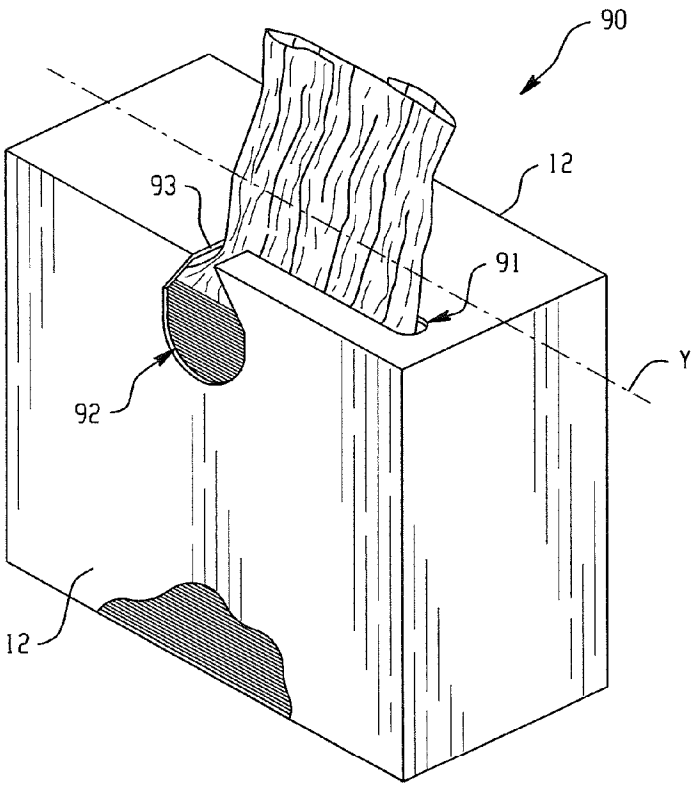
FIG. 4 is a perspective view of an embodiment of a dispenser for sheet products that illustrates one mode of operation of the dispenser.
Figure 6:
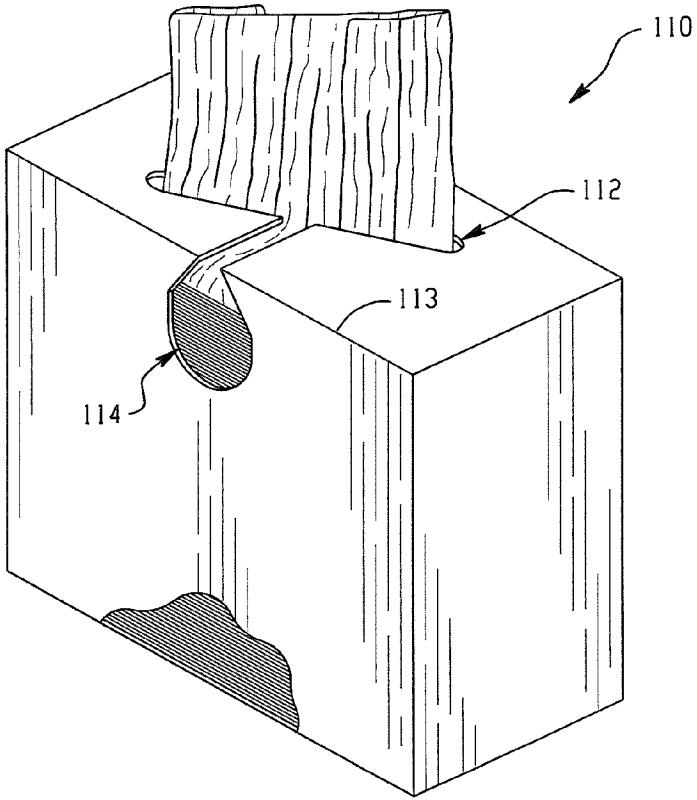
FIG. 6 is a perspective view of an embodiment of a dispenser for sheet products that illustrates one mode of operation of the dispenser.

Referring now to FIGS. 4-7, various other embodiments of the dispenser are illustrated. For ease in discussion, only those differences between dispenser 10 (FIGS. 1-3) are discussed. FIG. 4 shows dispenser 90 with a slot aperture 91 which is offset relative to aperture 92. In other words, aperture 92 is centered along the y-axis, while slot aperture 91 is not centered along the y-axis. The slot aperture is generally parallel to the side walls 12, with a channel 93 intersecting at an end of the slot aperture 91. FIG. 5 shows a dispenser 100 with an offset slot aperture 101 being angled relative to aperture 102. FIG. 6 shows a dispenser 110 with a centrally located slot aperture 112 being angled relative to edge 113 and aperture 114.

Figure 7:
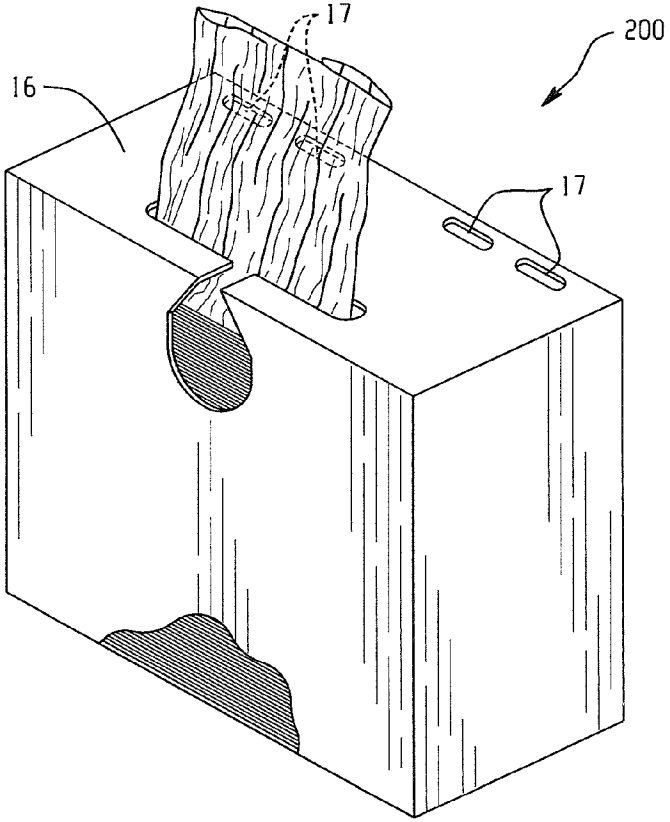
FIG. 7 is a perspective view of an embodiment of a dispenser for sheet products that illustrates one mode of operation of the dispenser.
Figure 8:
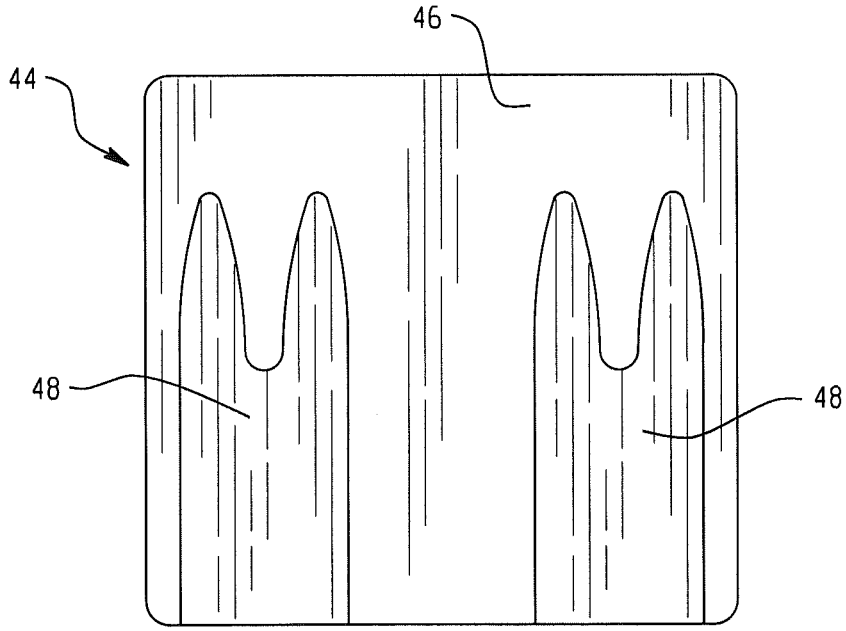
FIG. 8 is a front view of an embodiment of a mounting bracket.

Referring now to FIG. 7, one or more slits 17 can be provided in the dispensing wall 16 for mounting a dispenser 200. Mounting bracket 44, such as generally depicted in FIG. 8, has a mounting surface 46 for attaching bracket 44 to a wall or other surface (not shown). When attached to a wall, mounting surface 46 will lie substantially flush against the wall. Mounting bracket 44 further includes a pair of plates 48 that extend vertically and parallel with mounting surface 46. Slits 17 can be sized and spaced to accept plates 48. Dispenser 200 can then be placed upon plates 48 of mounting bracket 44, wherein plates 48 extend upwardly into the interior area of the dispenser 200, substantially flush with the inside of one of side wall 12, via slits 17.

EXAMPLES

Figure 9:
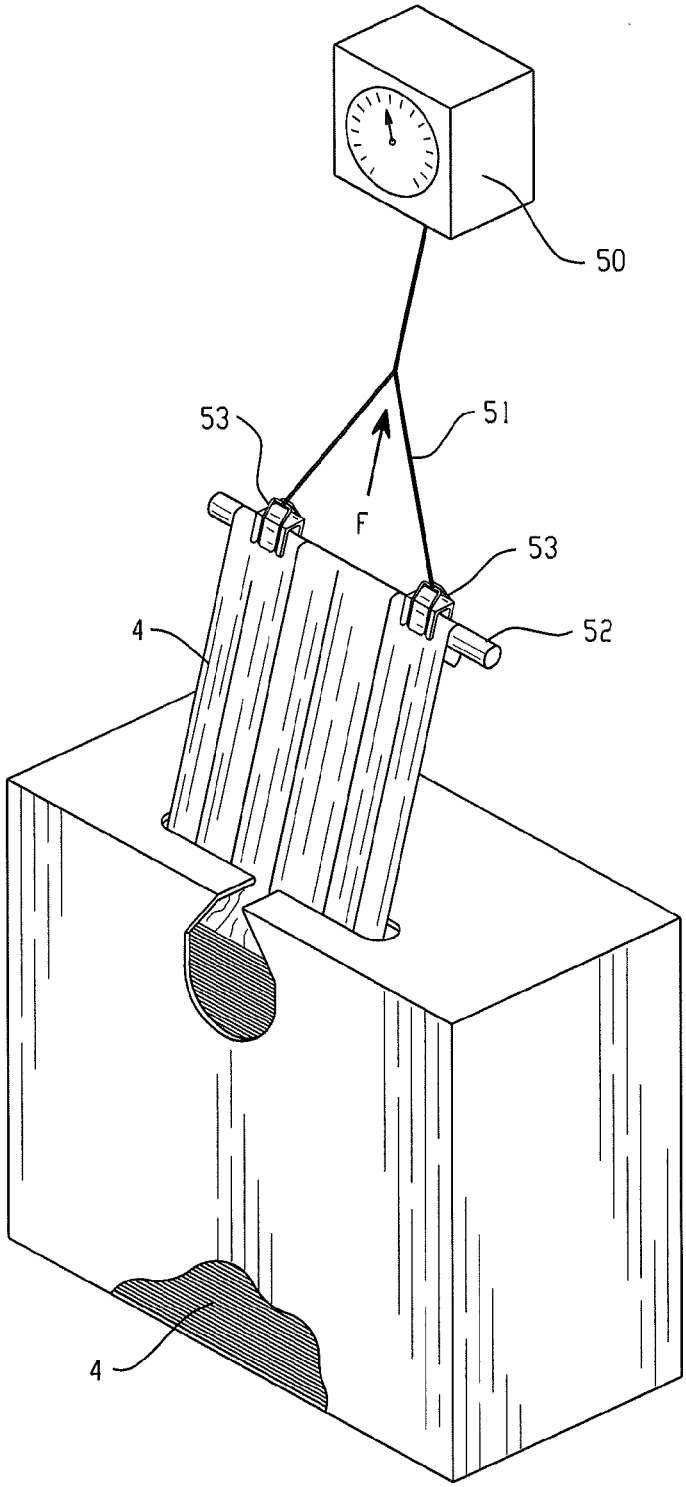
FIG. 9 is a perspective view of the dispenser of FIG. 1 depicted during an experiment to determine wiper release force.

With Reference to FIGS. 1 and 9, the forces needed to remove a wiper from the dispenser were evaluated by measuring the force to extract with a force meter 50. Force meter 50 was connected to one end of the sheet product 4 through line 51, dowel 52 and clamps 53 and pulled away from dispenser 10 to remove the sheet product 4 from dispenser 10. In this example, the sheet product was a hydroentangled wipe product. The length of the dispenser was about 9.1 inches along the y-axis, while the slot aperture had a length of about 3 inches and a width of 0.375 inches and was centered along the y-axis. The force, F, for 10 test runs is provided below in Table 1.

TABLE 1

| Run Number | Force (pounds (lbs)) |
|---|---|
| 1 | 2.45 |
| 2 | 1.90 |
| 3 | 2.65 |
| 4 | 2.70 |
| 5 | 3.25 |
| 6 | 2.65 |
| 7 | 3.55 |
| 8 | 2.20 |
| 9 | 3.80 |
| 10 | 2.80 |

The average force to remove wipers 4 from dispenser 10 was 2.795 pounds of force. The force was about 2 pounds to about 4 pounds.

In another experiment, approximately 100 wipes were removed from each of the dispenser 10. Zero (0) wipes experienced multiple pull-through and zero (0) wipes fell back into the dispenser 10.

Figure 10:
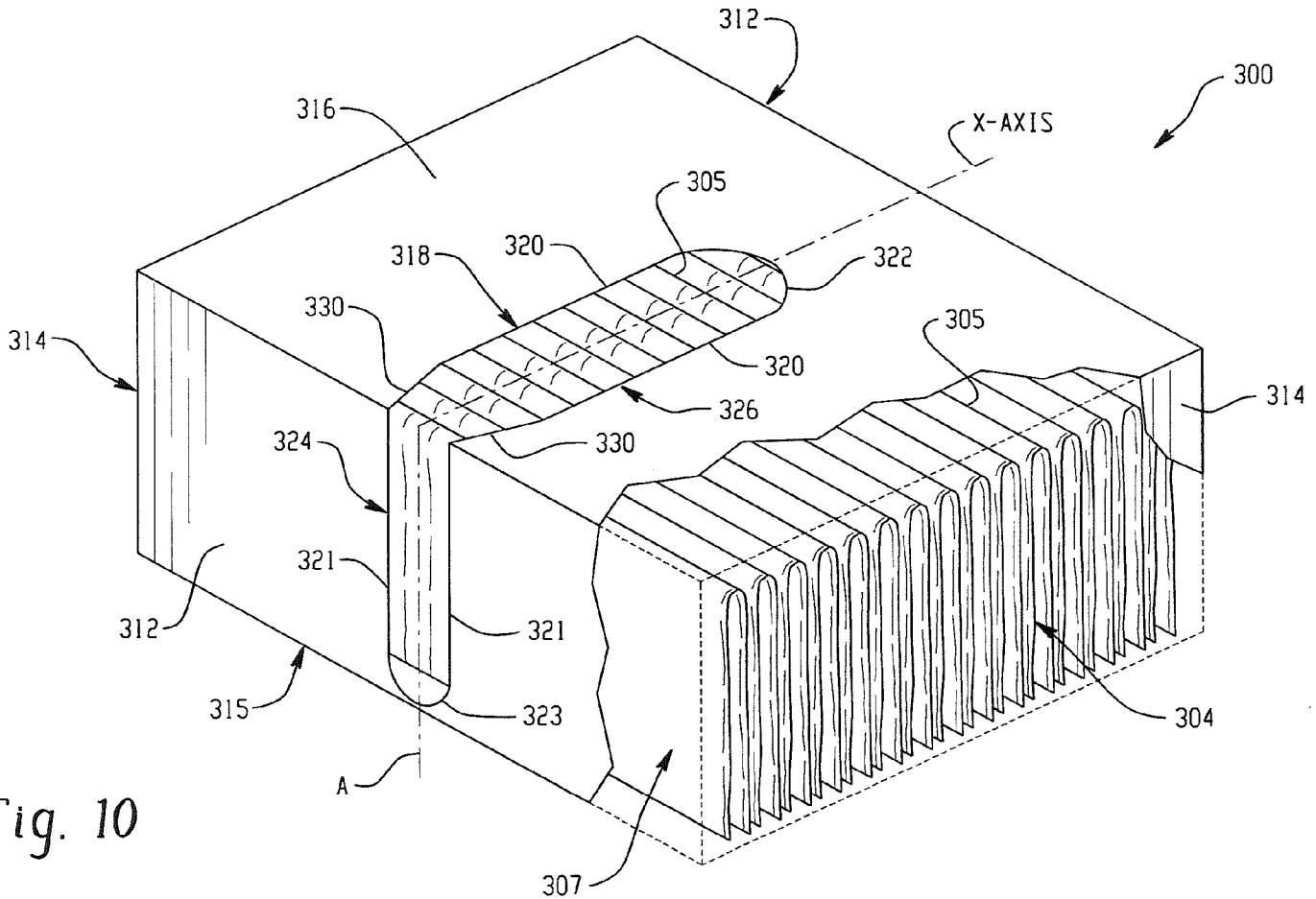
FIG. 10 is a perspective view of an alternative embodiment of a dispenser for sheet products in accordance with an embodiment of the invention.

With reference to FIG. 10, an alternative embodiment of dispenser 10 is illustrated by reference numeral 300, which will now be described in detail.

For convenience and ease of comparison, reference numerals used in conjunction with FIG. 10 have the form "3xx" where the numerals "xx" relate to those numerals, if applicable, used in describing the dispenser 10 in FIGS. 1-3, with alternative structure described hereafter.

Similar to dispenser 10, dispenser 300 can comprise a size and shape corresponding to the desired shape of the sheet products and the desired volume of the sheet products. Suitable shapes for the dispenser include, but are not limited to, parallelepiped, cylindrical and polygonal. For example, the dispenser 300 may be generally in the shape of an elongated box. In one embodiment, the dispenser 300 has an elongated box shape defined by six walls. More particularly, the dispenser 300 comprises two side walls 312 disposed adjacent to two end walls 314, a bottom wall 315 located adjacent to all of the side walls 312 and end walls 314, and a dispensing wall 316 located on the opposite end from the bottom wall 315 and is adjacent to all of the end walls 314 and side walls 312 of the dispenser 300. Similar to the prior description relating to dispenser 10, the terms side walls, end walls, bottom wall and dispensing wall relating to dispenser 300, and collectively herein referred to as the housing of the dispenser 300, are used merely for convenience in discussion and do not necessarily represent spatial orientation relative to the user. For example, in some embodiments the dispensing wall 316 may be located at the "front" of the dispenser 300 facing a user when the dispenser is installed, for example, with the bottom wall 315 mounted on a fixture such as a building wall.

Disposed in dispensing wall 316 is a first slot aperture 318, which is disposed in a central portion of the dispensing wall 316. In an embodiment, the first slot aperture 318 is disposed in the center of the dispensing wall 316 along the x-axis (shown as a dotted line). In the illustration of FIG. 10, the x-axis is perpendicular to the two side walls 312 and represents a major axis of the first slot aperture 318. The first slot aperture 318 is defined by a pair of generally parallel sides 320 that are in physical communication with each other via a rounded end 322 (e.g., U-shaped end). As such, the distance between parallel sides 320 corresponds to the "width" of the first slot aperture 318. The rounded end 322 advantageously helps to prevent tearing of the sheet product as it is dispensed through the first slot aperture 318. The sides 320 of the first slot aperture 318 are sufficiently spaced to permit sheet products 304 disposed within the housing to be grasped by one or more fingers of a human hand from outside of the housing in order to pass individual sheet products at least partially through the first slot aperture 318. In an embodiment, the distance from one side 320 to the other side 320 is about one-inch. In an embodiment, the slot length is about 50% of the overall distance from one side wall 312 to the other side wall 312.

In an embodiment, the first slot aperture 318 is connected to a second slot aperture 324, which is disposed in a side wall 312 via a channel 326, the channel 326 being disposed in the dispensing wall 316, and being defined by a pair of angularly disposed side walls 330 that connect side walls 320 of the first slot aperture 318 with side walls 321 of the second slot aperture 324 in a contiguous manner. In an embodiment, the second slot aperture 324 has a major axis "A" (shown as a dotted line) oriented perpendicular to the dispensing wall 316 and the bottom wall 315. The major axis "A" of the second slot aperture 324 is oriented relative to the major x-axis of the first slot aperture 318 such that the first slot aperture 318 and the second slot aperture 324 define a contiguous aperture (depicted generally by reference numerals 318 and 324 in combination) between the dispensing wall 316 and a first of the two side walls 312. The second slot aperture 324 is defined by a pair of generally parallel sides 321 that are in physical communication with each other via a rounded end 323 (e.g., U-shaped end). As such, the distance between parallel sides 321 corresponds to the "width" of the second slot aperture 318. The second slot aperture 324 has a width less than a width of the first slot aperture 318. In an embodiment, the second slot aperture 324 has a width of about 0.5 inches. The second slot aperture 324 is sufficiently large to permit the individual sheet products to pass at least partially through the second slot aperture, and is sufficiently narrow to prevent streaming of subsequent sheet products after a first of the sheet products has been dispensed. In an embodiment, the second slot aperture 324 has a length that extends along a first of the side walls 312 that is substantially equal to a height of the respective side wall 312. The rounded end 323 advantageously helps to prevent tearing of the sheet product as it is dispensed through the second slot aperture 324.

In one embodiment, the dispenser 300 may be formed from a single sheet of paperboard blank stock similar to that discussed above in connection with FIG. 2.

In an embodiment, dispenser 300 includes a plurality of sheet products 304 disposed within its housing, where each of the plurality of sheet products 304 have an edge 305 disposed proximate the dispensing wall 316 and oriented perpendicular to the major x-axis of the first slot aperture 318, such that a stack of the plurality of sheets disposed within the housing orients a planar surface 307 of each sheet product parallel to the two side walls 312.

In an embodiment, the sheet products 304 are disposed within the dispenser 300 such that they are releasably attached to each previous and subsequent sheet product (except, respectively, for the first and last) by any releasable attachment means that allows easy separation to occur as the sheet product is being dispensed. Suitable releasable attachment means include, but are not limited to, friction, cohesion, or other forces that releasably attach adjacent articles. Perforations upon the articles may serve to provide releasable detachment between adjacent articles. In one embodiment, perforations may be defined by a series of 0.030 inch perforations. Where articles are interleaved, releasable attachment results from friction or cohesion between adjacent articles. One skilled in the art can readily determine the appropriate configuration without undue experimentation to assure separation of the articles without undue tearing as well as assuring that the article is dispensed through the dispenser aperture(s) 318, 324 to assure availability of the succeeding article in a pop-up mode.

In each of the embodiments of dispensers disclosed, the problems of fall-back, double pull, multiple pulls, and streaming are either eliminated or reduced through use of the slot aperture. The dispensers allow for single pull and ease of use to the user. It is further noted that while the dispensers have been discussed for use with sheet products, it is to be understood that the advantages obtained for sheet products may also be realized for other products including, but not limited to, plastics (e.g., plastic bags), and cloths.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A dispenser, comprising:

a housing including a dispensing wall, a bottom wall disposed opposite the dispensing wall, two side walls connecting the dispensing wall to the bottom wall, and two end walls connecting the dispensing wall, the bottom wall and the two side walls;

a plurality of sheet products disposed within the housing, each of the plurality of sheet products oriented with their planar surface parallel to the dispensing wall;

a first slot aperture disposed in the dispensing wall centered between the two end walls, the first slot aperture having a major axis oriented parallel to each of the two side walls and configured to grasp and retain the individual sheet products, the first slot aperture having a length along the major axis of about 20% to about 50% of a width of the sheet products; and a second slot aperture disposed in a first of the two side walls, the second slot aperture having a major axis transverse to the major axis of the first slot aperture and configured such that the first slot aperture and the second slot aperture connect to form one contiguous aperture that extends across a shared edge between the dispensing and first side walls, the second slot aperture having a length that is less than or equal to half the height of the first side wall.

2. The dispenser of claim 1, wherein:

the major axis of the second slot aperture is oriented perpendicular to the dispensing wall and the bottom wall.

3. The dispenser of claim 1, wherein:

the first slot aperture is sufficiently large to permit sheet products disposed within the housing to be grasped by one or more fingers of a human hand from outside of the housing in order to pass individual sheet products at least partially through the first slot aperture.

4. The dispenser of claim 3, wherein:

the second slot aperture is sufficiently large to permit the individual sheet products to pass at least partially through the second slot aperture, and is sufficiently narrow to prevent streaming of subsequent sheet products after a first of the sheet products has been dispensed.

5. The dispenser of claim 1, wherein:

the first slot aperture is connected to the second aperture via a channel disposed in the dispensing wall, the channel being defined by a pair of angularly disposed side walls that connect side walls of the first slot aperture with side walls of the second slot aperture in a contiguous manner.

6. The dispenser of claim 5, wherein:

the first slot aperture is defined by a pair of parallel side walls.

7. The dispenser of claim 6, wherein:

the second slot aperture is defined by a pair of parallel side walls.

8. The dispenser of claim 7, wherein:

the second slot aperture comprises an end, opposite the channel, having a rounded U-shaped profile.

9. A dispenser, comprising:

a housing including a dispensing wall, a bottom wall disposed opposite the dispensing wall, two side walls connecting the dispensing wall to the bottom wall, and two end walls connecting the dispensing wall, the bottom wall and the two side walls;

a plurality of sheet products disposed within the housing, each of the plurality of sheet products oriented with their planar surface parallel to the dispensing wall;

a first slot aperture disposed in the dispensing wall centered between the two end walls, the first slot aperture having a major axis oriented parallel to each of the two side walls and configured to grasp and retain the individual sheet products, the first slot aperture having a length along the major axis of about 20% to about 50% of a width of the sheet products;

a second slot aperture disposed in a first of the two side walls, the second slot aperture having a major axis transverse to the major axis of the first slot aperture and a length that is less than or equal to half the height of the first side wall, the second aperture being sufficiently large to permit the sheet products to be grasped by one or more fingers of a human hand therethrough; and a channel extending across a shared edge between the dispensing and first side walls and connecting the first slot aperture and the second slot aperture to form one contiguous aperture, the channel having a width smaller than a width of the second slot aperture, wherein the first slot aperture is parallel to the first side wall and is disposed away from the first side wall.

10. The dispenser of claim 9, wherein the first slot aperture is disposed away from the first side wall in a distance greater than or equal to the width of the first slot aperture.

* * * * *